United States Patent [19]

Aikens

[11] Patent Number: 4,585,288

[45] Date of Patent: Apr. 29, 1986

[54] RECTILINEARALLY LATCHABLE ZERO INSERTION FORCE CONNECTOR

[75] Inventor: Paul W. Aikens, Etters, Pa.

[73] Assignee: E. I. Du Pont de Nemours and Company, Wilmington, Del.

[21] Appl. No.: 561,298

[22] Filed: Dec. 14, 1983

[51] Int. Cl.[4] ..... H01R 9/09

[52] U.S. Cl. ..... 339/75 MP; 339/91 R; 339/176 MP

[58] Field of Search ..... 339/91 R, 75 MP, 176 MP

[56] References Cited

U.S. PATENT DOCUMENTS

| | | | |
|---|---|---|---|
| Re. 29,233 | 5/1977 | Pritulsky | 339/75 |
| 3,744,005 | 7/1973 | Sitzler | 339/75 |
| 3,793,609 | 2/1974 | McIver | 339/74 |
| 3,818,419 | 6/1974 | Crane | 339/74 |
| 3,920,303 | 11/1975 | Pittman et al. | 339/91 R |
| 3,942,854 | 3/1976 | Klein et al. | 339/75 |
| 3,980,377 | 9/1976 | Oxley | 339/75 |
| 4,023,878 | 5/1977 | Hennessey | 339/17 |
| 4,050,758 | 9/1977 | Curley | 339/74 |
| 4,060,300 | 11/1977 | Jayne et al. | 339/74 |
| 4,077,688 | 3/1978 | Cobaugh et al. | 339/74 |
| 4,085,990 | 4/1978 | Jayne | 339/74 |
| 4,118,094 | 10/1978 | Key | 339/75 |
| 4,119,357 | 10/1978 | Bonhomme | 339/75 |
| 4,128,289 | 12/1978 | Occhipinti | 339/176 MP |
| 4,136,917 | 1/1979 | Thew et al. | 339/91 R |
| 4,204,722 | 5/1980 | Yasui et al. | 339/17 |
| 4,266,839 | 5/1981 | Aikens | 339/75 |
| 4,279,459 | 7/1981 | Sherman | 339/75 MP |
| 4,330,163 | 5/1982 | Aikens et al. | 339/75 MP |
| 4,346,952 | 8/1982 | Bright et al. | 339/17 LF |

FOREIGN PATENT DOCUMENTS

| | | | |
|---|---|---|---|
| 2502521 | 8/1976 | Fed. Rep. of Germany | 339/75 MP |
| 866052 | 4/1961 | United Kingdom | 339/75 MP |

*Primary Examiner*—John McQuade

[57] ABSTRACT

A zero insertion force connector is provided with a housing and a latching member rectilinearly displacable with respect to the housing. A circuit board, receivable within the housing, is displaced with respect thereto from an initial to a final position in which the board abuts against a predetermined abutment surface on the housing. As the board is displaced, the final position of the board engages against a resilient contacting member which is successively urged in a first wiping direction across the conduction stripe on the board and thereafter, into a counter backwiping direction along the stripe.

10 Claims, 8 Drawing Figures

RECTILINEARALLY LATCHABLE ZERO INSERTION FORCE CONNECTOR

BACKGROUND OF THE INVENTION

1. Field of the Invention

This invention relates to a zero insertion force connector and, in particular, to a zero insertion force connector which is latched into position by rectilinear displacement of a latch with respect to the connector housing.

2. Description of the Prior Art

Connectors of the type which present substantially no opposition to the insertion of a circuit board or other substrate thereinto are known in the art as zero insertion force connectors. Such connectors eliminate frictional forces which tend to oppose the entry of a substrate into the connector. Such forces, when summed over the number of conduction paths on the substrate, present a not inappreciable opposite to the insertion of the substrate which could result in undue frictional wear on and premature failure of the conduction paths on the substrate.

Exemplary of known zero insertion force connectors is that shown in U.S. Pat. No. 4,266,839 (Aikens), assigned to the assignee of the present invention. This patent discloses a zero insertion force toggle link connector which utilizes a toggle rod and a substantially S-shaped spring contact arranged such that circular movement of the toggle rod in a first direction causes the spring contact to engage and wipe the conduction path on the substrate while reversal of the movement of the toggle rod causes the spring contact to disengage from the conduction path on the substrate.

Special problems are encountered when one is confronted with the problem of terminating and connecting printed circuit boards or other substrates provided on one side thereof with a ceramic or porcelain-on-steel finish. Ceramic surface printed circuit boards carry sharp edges which, if care is not exercised, may shear the pin contacts carried by the connector thus vitiating the connector for its intended purpose. Porcelain-on-steel printed circuit boards include an edge meniscus which must be overcome or avoided before the contacts on the connector may engage the conduction paths on the board. None of the known zero insertion force connectors in the art is believed able to accept and electrically engage the conduction paths on ceramic-surfaced or porcelain-on-steel printed circuit boards in a zero insertion force mode.

Accordingly, in view of the foregoing, it is believed advantageous to provide a zero insertion force connector which is especially adapted for accepting and electrically engaging conduction paths disposed on ceramic surfaced or porcelain-on-steel printed circuit boards.

SUMMARY OF THE INVENTION

The invention relates to a zero insertion force connector especially adapted for use with ceramic or porcelain-on-steel printed circuit boards. The connector includes a housing formed of a dielectric material which carries an array of resilient contacts disposed in a recessed portion of the housing. The contacts correspond in a one-to-one relationship with a conduction path on the board. The housing provides guide posts at each end of the housing, the guide posts having an abutment surface on one side thereof and an inclined cam surface having a detent groove on the opposed side thereof. A latch is slidably received on the guide post and is movable along the cam surface of each post from an open position to a latched position. An array of bias springs is provided on the latch. A ceramic or porcelain-on-steel circuit board is receivable into and supported by a planar shelf in the connector when the latch occupies the open position. Rectilinear displacement of the latch with respect to the guide posts on the housing from the open to the latched position causes a translating force to be generated by the bias springs and imposed onto the circuit board which tends to progressively displace the same from its initial position to a final position in which the board engages the abutment surface on the posts. As the board is urged toward the final position the board progressively engages and pivots each of the contacts with respect to the housing across the conduction path corresponding thereto in a first, wiping, direction. Further progressive advancement of the board to the abutting position sequentially thereafter causes the contacts to slide with respect to the housing along the guide surface in an opposing backwiping direction to thereby locate the contacts over a freshly wiped portion of the conduction path on the board.

BRIEF DESCRIPTION OF THE DRAWINGS

The invention may be more fully understood from the following detailed description thereof, taken in connection with the accompanying drawings which form a part of this application and in which.

DETAILED DESCRIPTION OF THE INVENTION

Figure 1:
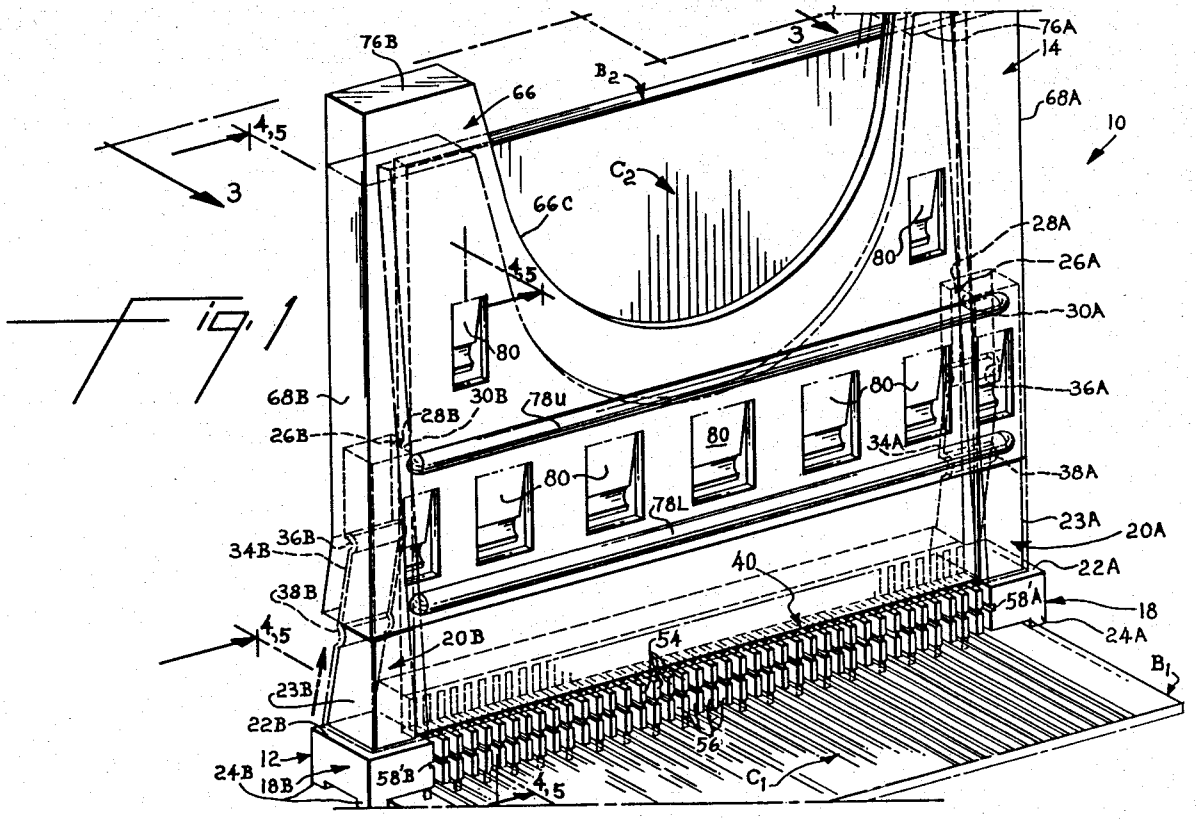
FIG. 1 is a perspective view with zero insertion force connector in accordance with the present invention with the latch thereof in the open position with respect to housing.

Throughout the following, detailed description similar reference numerals refer to similar elements in all figures of the drawings.

The zero insertion force connector generally indicated by reference character 10 comprises, in accordance with the present invention, a dielectric housing 12 adapted to cooperably receive a latch generally indicated by reference character 14. The connector 10, in its typical operating environment, is mounted on a first circuit board or other substrate $B_1$ having an array of conduction paths $C_1$ disposed thereon. The connector 10 is arranged to electrically engage conduction paths $C_2$ provided on a ceramic-surfaced or porcelain-on-steel circuit board $B_2$ such that each conduction path $C_2$ on the board $B_2$ is electrically interconnected with a corresponding conduction path $C_1$ on the board $B_1$. It is advantageous that the insertion of the board $B_2$ into the connector 10 encounter minimal insertion force for the reasons outlined above.

The housing 12 is formed of a suitable plastic dielectric material and includes a base portion 18 having upstanding posts 20A and 20B projecting from pedestals 22A and 22B disposed at each axial end thereof. The outer lateral surfaces of the posts 20 define guide surfaces 23A and 23B, respectively. The base 18 may be provided with suitable standoffs 24A and 24B to support the base above the surface of the board $B_1$.

Figure 5:
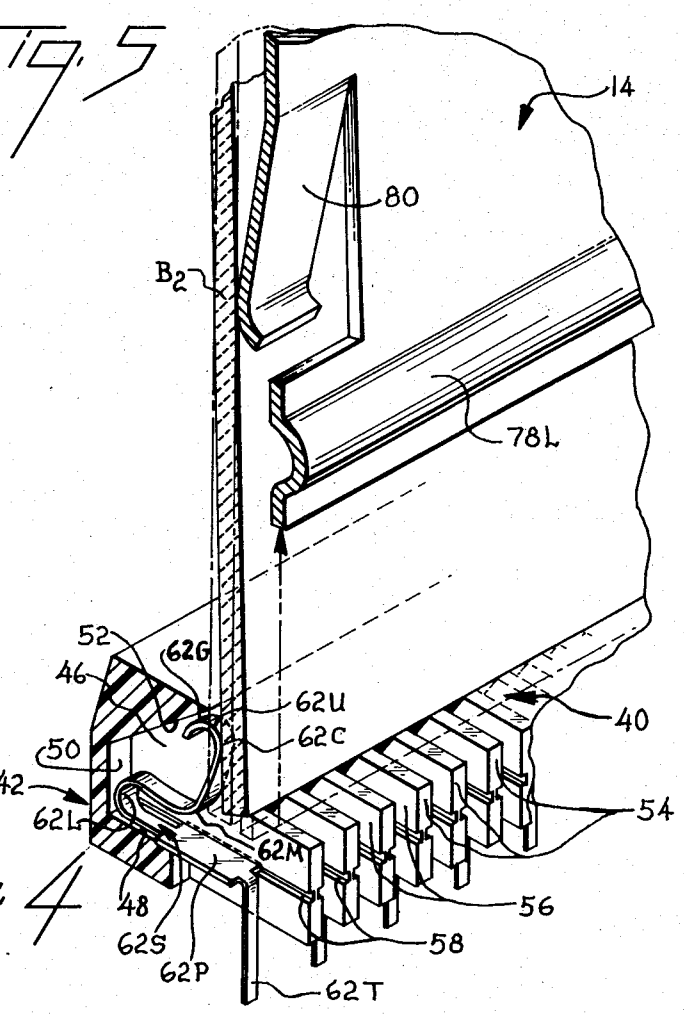
FIG. 5 is a perspective view similar to FIG. 4 illustrating the circuit board in the final position with respect to the housing.
Figure 4:
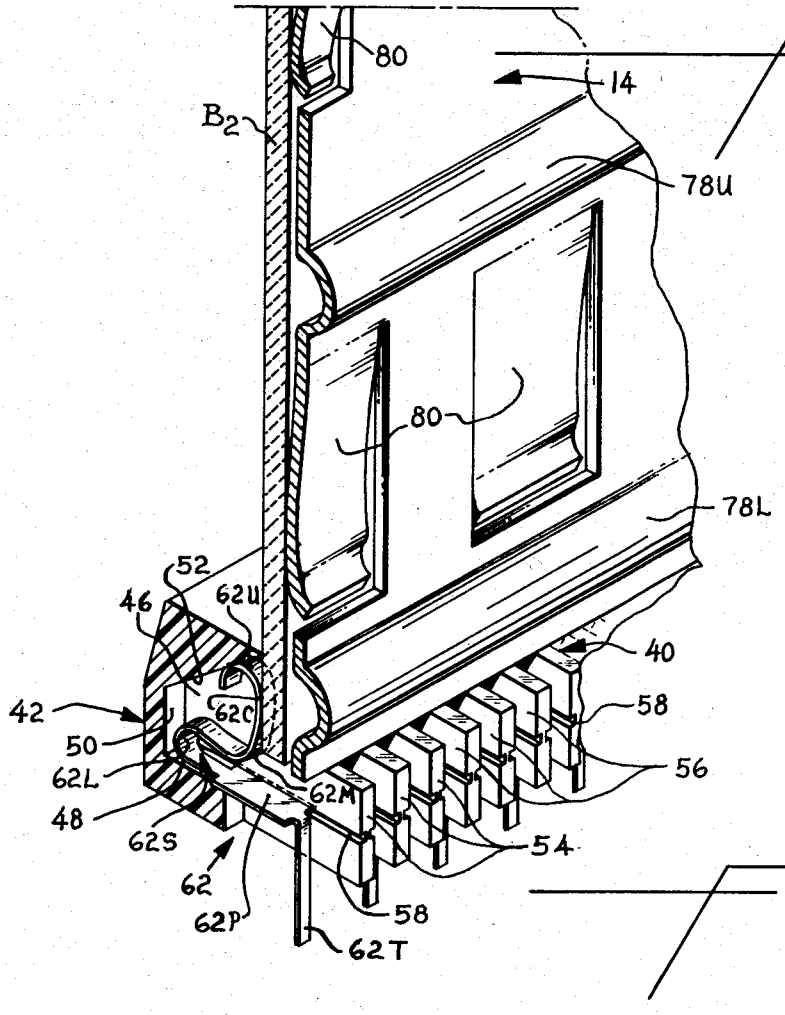
FIG. 4 is an enlarged perspective view of the relationship of the circuit board and the contacts carried by the connector housing with the board in the initial position with respect to the housing.

The confronting faces of the posts 20A and 20B are notched, as at 26A and 26B, to define frontally facing board abutment surfaces 28A and 28B and associated board guide surfaces 30A and 30B which communicate with the respective board abutment surfaces 28A and 28B. The rear surface of each of the posts 20A and 20B has an inclined cam surface 34A and 34B arranged respectively thereon. The cam surface 34A and 34B is defined between a respective upper detent groove 36A and 36B and a lower detent groove 38A and 38B. The base is stepped, as at 40, in that region between the confronting board guide surfaces 30A and 30B. The stepped portion 40 of the base 18 is notched or undercut, as at 42 (FIGS. 4 and 5), to form in the main portion of the base 18 a contact receiving recess 46. The recess 46 is defined by a support wall 48, a back wall 50 and a camming wall 52 (FIGS. 4 and 5). The portion of the base 18 projecting forwardly from the recess 46 is cut to form substantially parallel partitions 54 which cooperate to define an array of adjacent contact receiving regions 56. The upper surfaces of each of the partitions 54 cooperate to define a substantially planar board support shelf.

Figure 2:
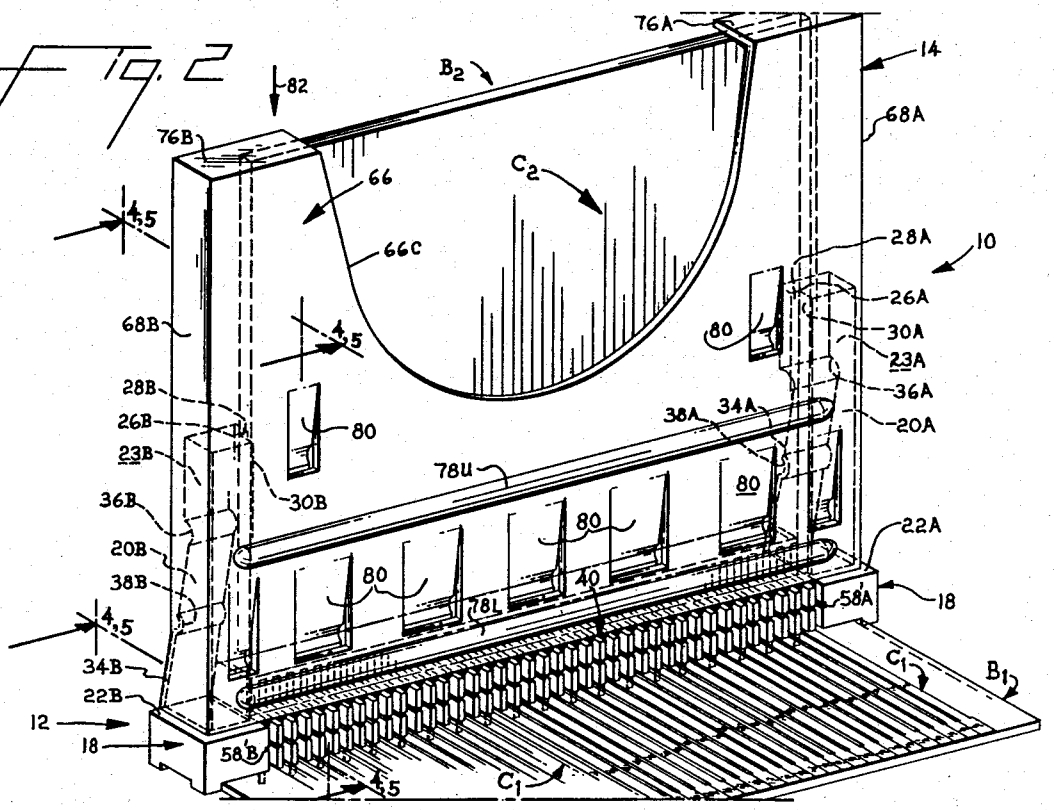
FIG. 2 is a view similar to FIG. 1 illustrating the connector in accordance with the present invention with the latch in the latched position.
Figure 3:
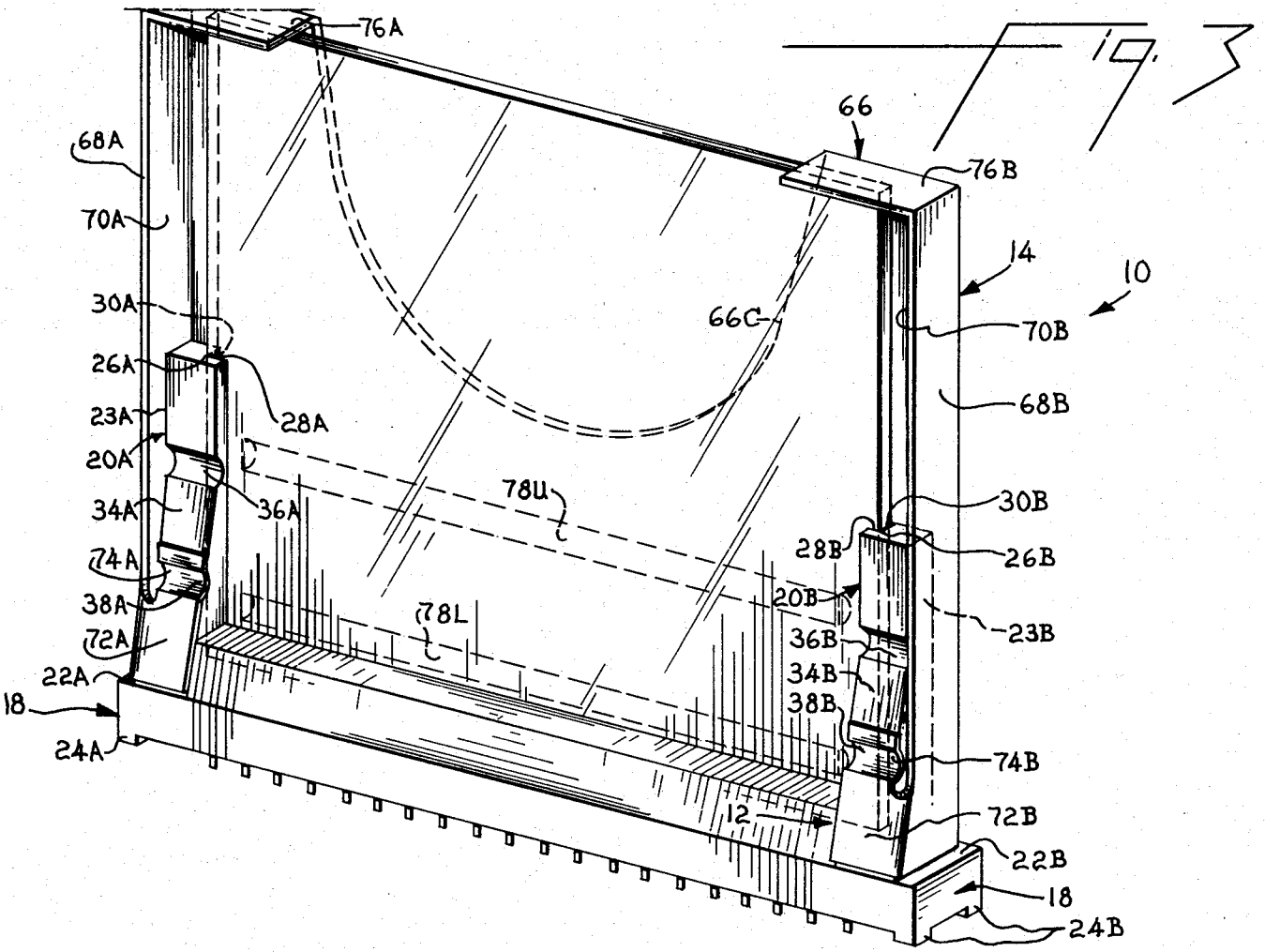
FIG. 3 is a perspective view of the latch taken substantially along view lines 3—3 in FIG. 1.

Each of the partitions 54 is provided on each lateral surface thereof with grooves 58 (FIGS. 4 and 5). The inward lateral face of each of the pedestals 22A and 22B is provided with a corresponding groove 58'A and 58'B (FIGS. 1 and 2). Each pair of confronting grooves 58 (or groove 58 and confronting groove 58'A and 58'B in the case of the axially outermost grooves) is arranged to receive a generally flatened guide plate 62P of a resilient electrically conductive contact member 62 (omitted from FIGS. 1 through 3 for clarity). The guide plate portion is supported on the support wall 48 of the recess 46. One end of the guideplate 62P has downwardly extending contacting tine 62T depending therefrom. The depending tines 62T are adapted for interconnection and electrical engagement with the conducting paths $C_1$ on the board $B_1$ in any suitable manner. The opposite end of the guideplate 62P is connected to one free end of a substantially inverse-S-shaped section portion 62S. The lower bend 62L of the section 62S confronts the back wall 50 of the recess 46. A contacting surface portion 62C is defined between the middle bend 62M and the upper bend 62U of the section 62S. A guide surface 62G (FIG. 4) is defined along the upper outer surface of the section 62S. In accordance with this invention and in a manner to be discussed in full detail herein a freshly wiped portion of the conduction strip $C_2$ on the board $B_2$ is brought into electrical contact with the contacting surface 62C of the section 62S.

In practice, the housing member above described may be suitably formed by injection molding or the like. An array of contacts 62, each adhered to a leader strip, may be inserted such that edges of the guide plate portions 62P of each are received in the appropriate ones of the grooves 58 (and 58'A and 58'B if appropriate). The leader may then be removed once each of the contacts 62 is in place within the base 18. The appropriate board abutment surfaces 28A and 28B and board guide surfaces 30A and 30B, as well as cam surfaces 34A and 34B and latch grooves 36A and 36B and 38A and 38B may be appropriately machined into the housing 12.

The latch 14 has a substantially planar body portion 66 which is provided with an accurate cutout 66C for the purpose of facilitating manipulation of the board $B_2$. Opposed flaps 68A and 68B at each end of the planar body 66 are folded toward each other to define guide surfaces 70A and 70B (FIG. 3), respectively. The guide surfaces 70A and 70B are arranged to closely lie against the respective guide surfaces 23A and 23B of the posts 20A and 20B as the latching member 14 is advanced rectilinearly with respect to the housing 12 in a manner to be discussed. The lowermost ends of the flaps 68A and 68B include latch tabs 72A and 72B. The latch tabs are themselves provided with a respective depression 74A and 74B adapted to form a latching detent engageable with either of the upper or lower latch grooves 36A and 36B and 38A and 38B. Flanges 76A and 76B defined between the cutout 66C and the flaps 68A and 68B are bent perpendicularly to the body 66 to form cap flanges adapted to overlie the tops of the posts 20A and 20B, respectively, when the latch 14 is in a latched position. The body member 66 is corrugated, as 78U and 78L in order to impart structural rigidity thereto. An array of tongues 80 (omitted from FIG. 3 for clarity) is cut into the body portion 66. The tongues 80 when depressed inwardly toward that region partially enclosed by the flaps 68A and 68B and the flanges 76A and 76B serve to form cantilevered bias springs which impart a resilient biasing force against the board $B_2$.

Typically, the latch 14 may be formed by stamping and cutting a planar piece of stock and thereafter folding the same to define the flaps 68A and 68B, tabs 72A and 72B and the flanges 76A and 76B.

In operation, with the latch 14 in the open position (FIG. 1) the circuit board $B_2$ is introduced into the connector 10 such that the front of the circuit board $B_2$ (that is the surface of the board having conduction paths $C_2$ thereon) facing the respective abutment surfaces 28A and 28B on the posts 20A and 20B. The lateral edges of the board $B_2$ are confined and guided by the board guide surfaces 30A and 30B provided on each of the posts 20A and 20B respectively. The lower edge of the board $B_2$ lies on the planar shelf defined by the coplanar upper surfaces of each of the partitions 54.

With the board $B_2$ inserted into the connector 12 into the initial position above described the board $B_2$ is inclined slightly with respect to the board abutment surface 28A and 28B. It is noted that the insertion of the board $B_2$ into the connector 10 occurs with no opposing insertion force. Moreover, due to the angulation or inclination of the board $B_2$, the tendency of a ceramic board to shear the contacting pin is avoided. Alternatively, if the board $B_2$ is a porcelain-on-steel board, the edge meniscus of such a board is effectively avoided, since that edge meniscus is supported on the planar shelf defined by the walls and the conduction paths adjacent the periphery of the board are more readily accessible to the contacts 62.

Figures 6, 7, 8:
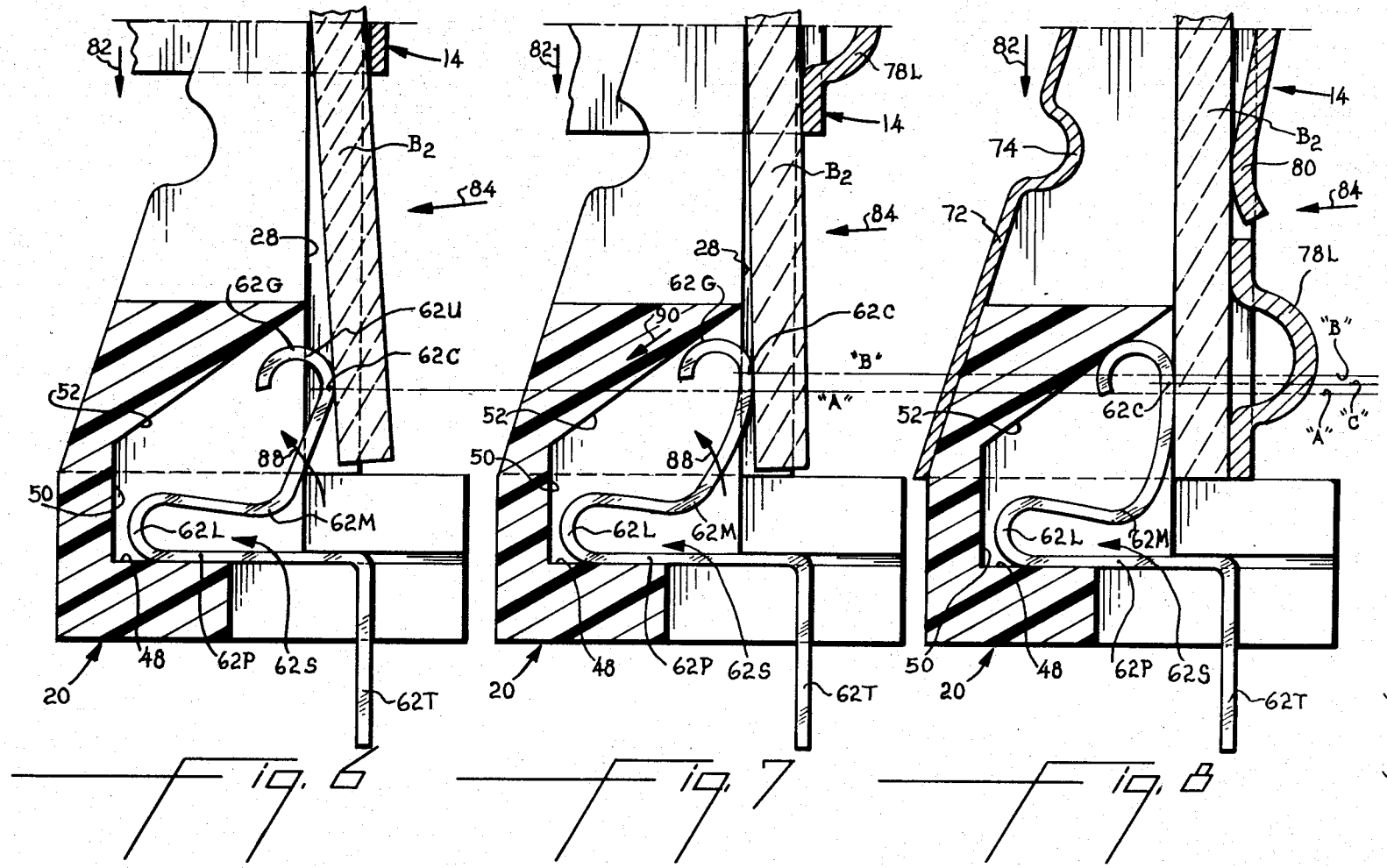
FIGS. 6, 7 and 8 are stylized diagrams illustrating the motion of the contacts with respect to the housing as the board is progressively moved with respect to the housing from the initial position to the final position.

With the board $B_2$ in the initial position, the latch 14 is advanced rectilinearly with respect to the housing from the open position (shown in FIG. 1) toward the latched position (shown in FIG. 2). The imposition of a closing force on the latching member 14 acting in direction of the arrow 82 (FIGS. 2, 6 through 8) unseats the detents 74A and 74B from their respective upper latch grooves 36A and 36B. Continued application of the closing force causes the detents 74A and 74B to ride along the respective inclined cam surfaces 34A and 34B. As the latching member 14 is so displaced, the cantilevered springs 80 impose a displacing force in the direction of arrow 84 (FIG. 6) on the undersurface of the board $B_2$ thereby displacing the same in that direction with respect to the housing from the initial position (FIGS. 1, 4 and 6) toward the final position (FIGS. 2, 5 and 8). In the final position, the lateral edges of the board $B_2$ are engaged substantially throughout their length against the abutment surfaces 28A and 28B.

As the latch 14 moves toward the latched position the bias springs 80 simultaneously urge the board $B_2$ along the shelf toward the abutting position. At a predetermined point in the board's travel a portion of the surface of the board contacts the contacting surface 62C of each of the contacts 62. This initial contact of the board $B_2$ with one of the contacts 62 is shown schematically in FIG. 6.

Thereafter, continued advancement of the board causes the section 62S to flex about the bends 62L and 62M and to thereby pivot the contacting surface 62C and cause the same to move across a portion of the surface of the associated conduction path in a wiping direction indicated in FIGS. 6 and 7 by reference arrow 88. The wiping action of the contacting surface 62C continues until the guide surface 62G engages the camming wall 52 within the recess 46. At this time, the contacting surface 62C has wiped and scraped the surface of the conducting path for a vertical distance measured along the path between the points A (where the contacting surface 62C first contacts the path, as in FIG. 6) to the point B (wherein the guide surface 62G engages the camming wall 52, as shown in FIG. 7).

Continued displacement of the board $B_2$ to the abutting position causes the guide surface 62G on the contact 62 to slide along the camming surface 52 in the direction of arrows 90 (FIG. 7), thereby imposing a backwiping action by the contacting surface 62C across the conduction path on the board. With the board $B_2$ in the final position against the board abutment surface 28, the contacting surface 62C on the contact 62 is presented against the portion of the conduction path at some freshly scraped location C intermediate the points A and B.

When the latch is displaced along the inclined cam surface 34 to the latching position, the detents 74A and 74B thereon engage the lower latching grooves 36A and 36B, thereby securing the latched member in the latched position. The bias force imposed by the biasing springs 80 serves to maintain the board $B_2$ into snug abutting engagement with the abutment surfaces 28A and 28B. It is noted that variations in the thickness of the board $B_2$ may be accomodated in accordance with the present invention by the provision of the bias spring 80. Moreover, the bias force as imposed by the springs 80 is selected so that at all times the bias force imposed by the springs 80 in the direction of the arrows 84 is greater than the opposing force imposed on the surface of the board by the resiliency of the contacts 62.

Those skilled in the art, having benefit of the teachings hereinabove set forth, may readily appreciate that a zero insertion force connector has been provided which is especially adapted for use with ceramic surfaced or porcelain-on-steel circuit boards. The connector is arranged such that in the open position a board may be readily introduced and received by the connector at an initial orientation such that the board is noninjuriously received within the connector. Thereafter, rectilinear displacement of the latch from the open to the latched position causes the board to displace with respect to the housing from the initial to the final position. At some intermediate point during the displacement of the board the surface of each conduction path thereon is brought into contact with a resilient contact. Continued displacement of the board generates movement by the contact in a wiping direction over the surface of the conduction path, thereby scraping any accumulated foreign matter or dielectric film which may be present on the conduction path. Further progressive advancement of the board within the housing moves the contact over the conduction path in a backwiping direction such that the contact is brought to rest against a freshly scraped portion of its associated conduction path when the latch is latched and the board positioned in the final abutment position.

Those skilled in the art having benefit of the teachings as hereinabove set forth may effect numerous modifications hereto. However, it is to be understood that such modifications lie within the scope of the present invention as defined by the appended claims.

What is claimed is:

1. A zero insertion force connector for electrically engaging a conduction path disposed on a substrate comprising:

a dielectric housing having an abutment surface thereon, the housing being adapted to receive a substrate introduced edgewise thereinto and to support the same in an initial position in which the substrate is inclined slightly with respect to the abutment surface;

an electrically conductive contact mounted within the housing;

a latch rectilinearly vertical displaceable with respect to the housing from an open to a latched position, the latch displacement direction and substrate introduction direction being substantially the same, displacement of the latch to the latched position imposing a displacing force on the substrate to move the same with respect to the housing from the initial to a final position in which the substrate abuts the abutment surface;

displacement of the latch progressively moving the substrate into engagement with the contact to cause the same sequentially to pivot with respect to the housing and to move across the conduction path in a wiping direction and thereafter to slide with respect to the housing and to move across the conduction path in a backwiping direction to present a portion of the contact in contacting relationship with a freshly wiped portion of the conduction path.

2. The connector of claim 1 wherein the housing has an inclined cam surface thereon along which the latch is slidable such that rectilinear displacement of the latch with respect to the housing generates the displacing force on the substrate.

3. The connector of claim 2 wherein the housing has a groove therein and the latch has a detent thereon such that the detent engages the groove when the latch is in the latched position.

4. The connector of claim 1 wherein the housing has a planar shelf defined thereon which supports the substrate as it moves from the initial to the final position.

5. The connector of claim 2 wherein the housing has a planar shelf defined thereon which supports the substrate as it moves from the initial to the final position.

6. The connector of claim 3 wherein the housing has a planar shelf defined thereon which supports the substrate as it moves from the initial to the final position.

7. The connector of claim 1 wherein the latch has a bias spring thereon, the bias spring being adapted to exert the displacing force on the substrate to move the same from the initial to the final position as the latch is displaced rectilinearly with respect to the housing from the open to the latched position.

8. The connector of claim 7 wherein the housing has an inclined cam surface thereon along which the latch is slidable such that rectilinear displacement of the latch causes the bias spring to engage against the substrate and to generate the displacing force thereon.

9. The connector of claim 8 wherein the housing has a groove therein and the latch has a detent thereon such that the detent engages the groove when the latch is in the latched position.

10. The connector of claim 9 wherein the housing has a planar shelf defined thereon which supports the substrate as it moves from the initial to the final position.

* * * * *